US005346112A

United States Patent [19]

Ziemek et al.

[11] Patent Number: 5,346,112

[45] Date of Patent: Sep. 13, 1994

[54] CAPSTAN DRAW APPARATUS FOR PERIODICALLY GRIPPING AND DRAWING AN ELONGATED MEMBER

[75] Inventors: Gerhard Ziemek; Harry Staschewski; Hermann Meyer, all of Langenhagen, Fed. Rep. of Germany

[73] Assignee: Kabelmetal Electro GmbH, Hanover, Fed. Rep. of Germany

[21] Appl. No.: 7,793

[22] Filed: Jan. 22, 1993

Related U.S. Application Data

[63] Continuation-in-part of Ser. No. 631,882, Dec. 21, 1990, abandoned.

[30] Foreign Application Priority Data

Feb. 13, 1990 [DE] Fed. Rep. of Germany ..... 4004312

[51] Int. Cl.[5] ..... B65H 20/00

[52] U.S. Cl. ..... 226/173

[58] Field of Search ..... 226/168, 170, 171, 172, 226/173

[56] References Cited

U.S. PATENT DOCUMENTS

| | | | |
|---|---|---|---|
| 1,288,866 | 12/1918 | Friel | 226/173 X |
| 1,759,105 | 5/1930 | Evans | 226/171 X |
| 2,867,480 | 1/1959 | Cushman | 226/170 X |
| 3,085,729 | 4/1963 | Lehnert | 226/173 |
| 3,116,865 | 1/1964 | Lehnart et al. | 226/173 |
| 3,128,930 | 4/1964 | Lehnert | 226/173 |
| 3,143,269 | 8/1964 | Van Eldik | 226/172 |
| 3,427,684 | 2/1969 | Tsien | 226/173 X |
| 3,580,451 | 5/1971 | Fraitzl | 226/173 |
| 3,618,840 | 11/1971 | Courret | 226/172 |
| 3,684,145 | 8/1972 | Jenkins | 226/173 |
| 3,690,534 | 9/1972 | Biron | 226/172 |
| 3,700,158 | 10/1972 | Schatz et al. | 226/173 X |
| 4,020,883 | 5/1977 | Nicholson | 226/170 X |
| 4,580,711 | 4/1986 | Iimura | 226/173 X |

*Primary Examiner*—Daniel P. Stodola
*Assistant Examiner*—Michael R. Mansen
*Attorney, Agent, or Firm*—James C. Jangarathis

[57] ABSTRACT

A capstan draw apparatus that includes a plurality of split clamps; a plurality of support carriages each having one of the split clamps positioned thereon; an endless chain drive mechanism for concurrently pulling each of the support carriages; and an elongated guide frame mechanism for successively closing and opening the split clamps about an elongated member. The apparatus further includes an endless lateral guide frame mechanism including first and second oppositely disposed, parallel endless lateral guide frames that are spatially positioned parallel to the endless chain drive mechanism and extend on opposite sides of the plurality of support carriages for continuously supporting each of the carriages in a positively guided manner for uniform movement thereof throughout their entire endless paths of rotation.

4 Claims, 3 Drawing Sheets

CAPSTAN DRAW APPARATUS FOR PERIODICALLY GRIPPING AND DRAWING AN ELONGATED MEMBER

CROSS REFERENCE TO RELATED APPLICATION

This application is a continuation-in-part of our U.S. patent application Ser. No. 07/631,882, filed Dec. 21, 1990, now abandoned.

BACKGROUND OF INVENTION

1. Field of Invention

The invention relates to an improved capstan draw apparatus for periodically gripping and longitudinally drawing an elongated member such as, for example, a freshly welded, tubular sheath between a welding station and a corrugating station.

2. Description of the Prior Art

Capstan draw apparatus of the type over which the present invention improves are priorly known from, for example, U.S. Pat. No. 3,085,729. Such prior art apparatus provides for the periodic gripping and longitudinally drawing of welded tubular sheaths by the employment of a plurality of split clamps, each including a pair of clamping elements, mounted on oppositely positioned, endless driven chains. Each of the split clamps periodically engage a portion of the outer circumferential surface of the welded tubular sheath for retaining a tight circumferential grip on the smooth sheath that prevents slipping and torsional turning of the sheath.

The priorly known apparatus of this type are employed, for example, in the manufacture of thin walled, longitudinally welded, corrugated metal sheaths. Such sheaths are manufactured by the sequential steps of continuously drawing a thin metallic band through a forming station in which the band is deformed into a smooth tubular sheath; longitudinally welding the longitudinally abutting edges of such smooth sheath to each other as such smooth tubular sheath is drawn longitudinally through a welding station; and longitudinally passing the freshly welded, smooth tubular sheath through a capstan draw apparatus which periodically grips and longitudinally draws such tubular sheath in the longitudinal direction and feeds same through a corrugating station. For obtaining a uniform hermetic seal along the longitudinally welded seam, the torque imparted to the freshly welded sheath at the downstream corrugating station is isolated from the welding station by the capstan draw apparatus.

Generally, in the priorly known capstan draw apparatus, each of the plurality of rotating split clamps is positioned along and mounted directly on the oppositely positioned, endless driven chains. Consequently, each movement emitted by the driven chains, or the associated drives, is translated to each pair of clamping elements, and to the portions of the smooth tubular sheath being tightly encompassed by those pairs of clamping elements making closed engagement therewith. In such prior art apparatus it is only those rotating split clamps that are in their closed condition about the smooth tubular sheath that are positively guided as the endless chains do not in themselves provide sufficient precise guidance to the split clamps to prevent undesirable thrusts and irregularities of movement; especially, for example, in the curved portions of the path of movement of the split clamps.

OBJECT OF THE INVENTION

The object of the present invention is to provide an improved capstan draw apparatus having a plurality of split clamps that are respectively positioned on support carriages which are driven in a positively guided manner along a predetermined endless path of rotation for uniform movement throughout their endless path of rotation.

SUMMARY OF THE INVENTION

The object of the present invention is achieved by a novel capstan draw apparatus that includes a plurality of split clamps; a plurality of support carriages each having one of the split clamps positioned thereon; an endless chain drive mechanism for pulling each of the support carriages in an endless path of rotation; an elongated guide frame mechanism for successively closing and opening the split clamps; and an endless lateral guide frame mechanism including first and second oppositely disposed, endless parallel guide frames for continuously supporting each of the carriages in a positively guided manner for uniform movement thereof during its entire endless path of rotation.

Preferably the lateral guide frame mechanism includes first and second parallel lateral guide frames extending on opposite sides of the total path of movement of the support carriages, with each of such frames having a U-shaped cross section for receiving and positively supporting a guide roller extending from each of the support carriages. This arrangement provides secure guidance against tilting or twisting of each of the support carriages throughout its entire endless path of rotation. Further, the opposite faces of the U-shaped sections of each of the lateral guide frames may be plastic coated, for example, so as to reduce the rolling resistance to the guide rollers of the support carriages, and simultaneously providing an attenuation effect to mechanical thrusts.

BRIEF DESCRIPTION OF THE DRAWINGS

A better understanding of the present invention as well as the objects and advantages thereof will become apparent upon consideration of the following detailed disclosure thereof, especially when taken with the accompanying drawings; wherein.

DESCRIPTION OF THE PREFERRED EMBODIMENT

Figure 1:
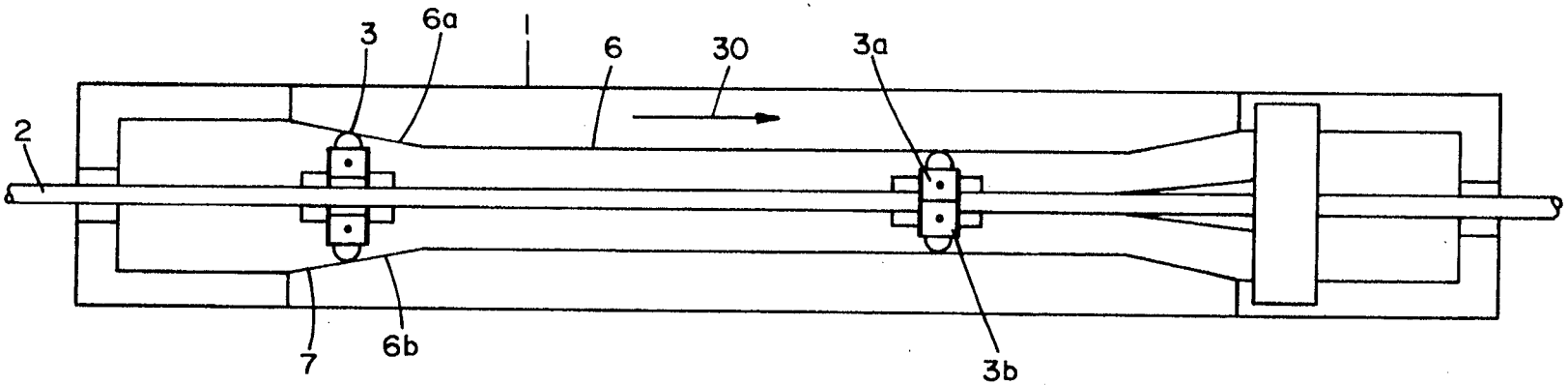
FIG. 1 is a diagrammatic top plan view of a capstan draw apparatus in accordance with a preferred embodiment of the present invention.
Figure 2:
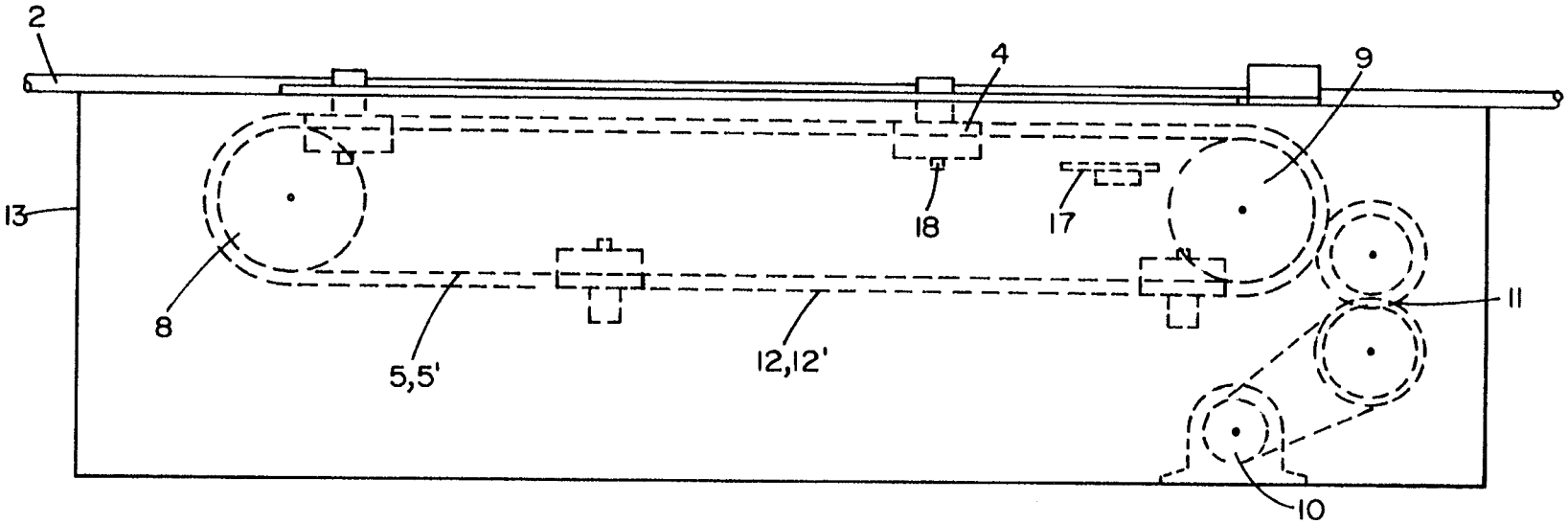
FIG. 2 is a diagrammatic side view of the capstan draw apparatus of FIG. 1.
Figure 3:
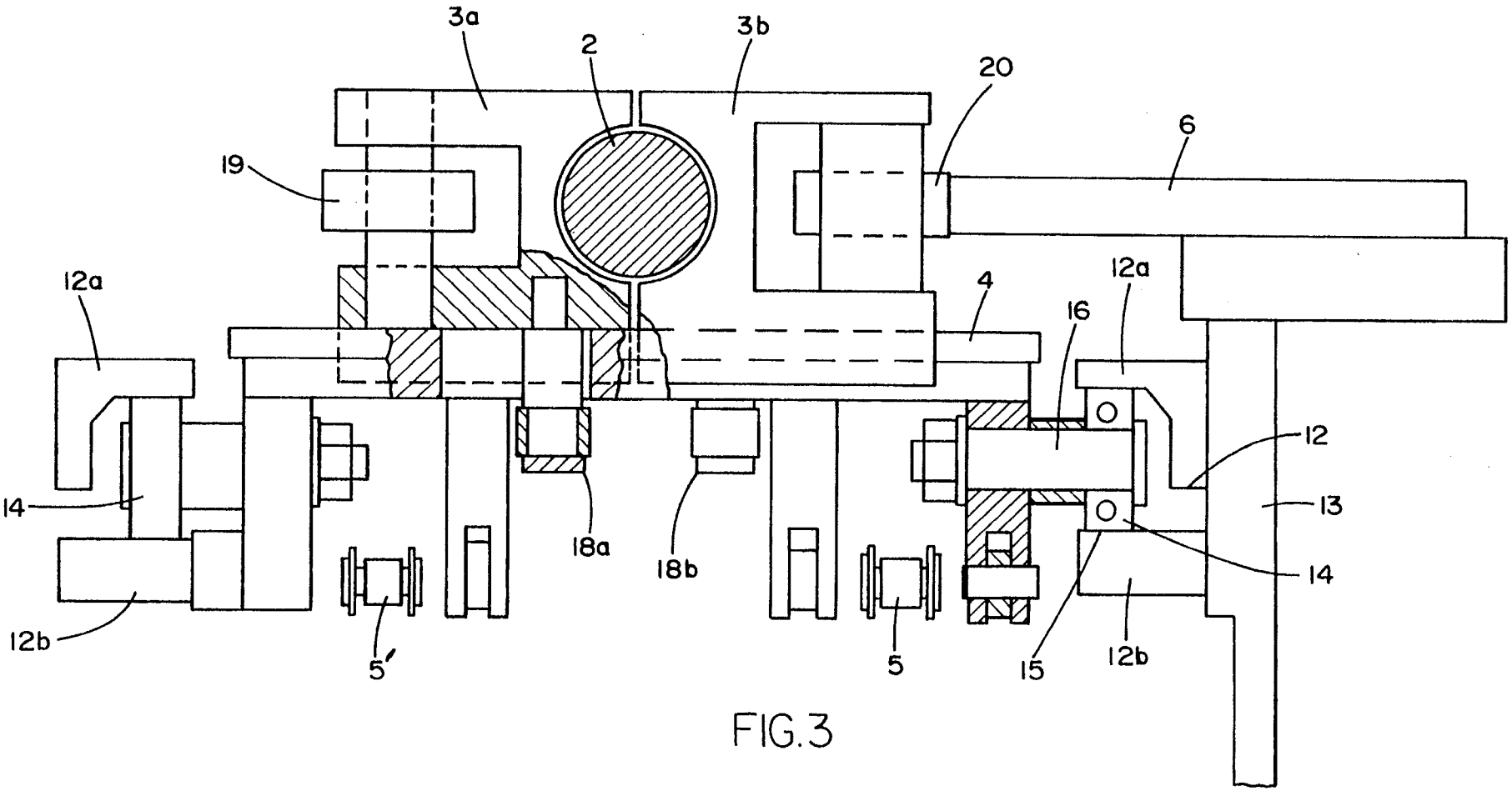
FIG. 3 is a diagrammatic front view of one of the split clamps and support carriages included in the capstan draw apparatus of FIGS. 1 and 2.

Referring to FIGS. 1 and 2, there is depicted a capstan draw apparatus 1 for periodically gripping and longitudinally drawing a longitudinally welded tubular sheath 2 in a path indicated by arrow 30 between, for example, a welding station (not shown) and a corrugating station (not shown). The capstan draw apparatus 1 includes a plurality of split clamps 3, each mounted on a support carriage 4 which is, in turn, connected to a pair of endless capstan chains 5 and 5' spatially positioned, parallel to each other. The split clamps 3 each comprise a pair of clamping elements 3*a* and 3*b* that, upon assuming their closed condition, closely fit about the outer circumference of the tubular sheath 2 so as to tightly grip the freshly welded sheath without doing damage to same. The split clamps 3 provide the additional function of absorbing torque imparted to the freshly welded sheath 2 during the downstream corrugation operation. The capstan draw apparatus 1 includes an elongated guide frame 6 positioned along and on opposite sides of a segment of the straight path to be followed by the longitudinally welded tubular sheath 2 as it is moved from the welding station toward the downstream corrugating station. The guide frame 6 includes two oppositely disposed guide sections 6*a* and 6*b*, which upon being successively engaged by the longitudinally moving split clamps 3, cause each successive pair of clamping elements 3*a* and 3*b* to close about a section of the tubular sheath 2, which then successively draws the tubular sheath 2 along the aforesaid straight path toward and into the vicinity of the output end of the capstan draw apparatus 1, and then permit the clamping elements 3*a* and 3*b* to spread apart and disengage from the tubular sheath. This interaction is achieved by the guide sections 6*a* and 6*b* of the elongated guide frame 6 being separated at the input end by a distance that permits each pair of clamping elements 3*a* and 3*b* to pass therebetween without engagement; then being separated by a decreasing distance along a short length of the guide frame 6 so as to engage each pair of clamping devices 3*a* and 3*b* for transversely closing them together about the longitudinally drawn tubular sheath 2; then being separated by a fixed distance along a further length of the guide frame 6 for maintaining the engaged clamping elements 3*a* and 3*b* in a closed condition; and then being separated by an increasing distance along an additional length of the guide frame 6 for permitting each successive pair of clamping elements 3*a* and 3*b* to transversely separate as it approaches the output end of the capstan draw apparatus 1.

At the output end of capstan draw apparatus 1, the paths of the endless capstan chains 5 and 5' curve from a straight line parallel to the straight line path of the tubular sheath 2 and, consequently, the path of each of the support carriages 4 and each of the pairs of clamping elements 3*a* and 3*b* positioned thereon, are deviated from the straight path of tubular sheath 2, and curve around to generally follow the path of the endless capstan chains 5 and 5'. The capstan draw apparatus 1 includes a pair of longitudinally separated support wheels 8 and 9 about which the endless capstan chains 5 and 5' are positioned parallel to each other, and a drive motor 10 connected to the support wheel 9 by means of a drive coupling 11.

For insuring a uniform, constant movement of the support carriages 4, and to avoid irregular longitudinal movement of the split clamps 3 that would cause undesirable changes in the freshly welded, tubular sheath 2, the capstan draw apparatus 1 includes oppositely disposed, parallel endless lateral guide frames 12 and 12'. The guide frames 12 and 12' are spatially positioned parallel to the endless capstan chains 5 and 5', and extend on opposite sides of the total path of rotation of the support carriages 4. Each of the endless lateral guide frames 12 and 12' is mounted on a housing 13 of the capstan draw apparatus 1, and is comprised of two lateral guide elements 12*a* and 12*b* for forming a U-shaped configuration for receiving a guide roller 14. Each of the support carriages 4 is continuously supported by the guide frame 12 or 12' adjacent thereto by means of a guide roller 14 that extends therefrom into the guide frame 12, between the guide elements 12*a* and 12*b*. For this purpose, the guide roller 14 is connected to the support carriage 4 by a bolt connection 16, and rolls on a plastic covered, running surface 15 of the guide element 12*b*.

As noted heretofore, the guide frame 6 is used for moving the clamping elements 3*a* and 3*b* toward each other to assume a closed condition about the longitudinally drawn tubular sheath 2. Advantageously, the clamping elements 3*a* and 3*b* include, respectively, adjustably mounted, roller members 19 and 20 which engage the oppositely disposed, guide sections 6*a* and 6*b*. For separating the clamping elements 3*a* and 3*b*, an opening wedge 17 is positioned in the vicinity of the support wheel 9 and below the path of travel of the support carriages 4, to engage a pair of separation extensions 18*a* and 18*b* of the clamping elements 3*a* and 3*b* for pushing same apart. The opening wedge 17 is dimensioned to provide an opening path between the clamping elements 3*a* and 3*b* for the tubular sheath 2 slightly greater than the dimensions of the tubular sheath. Thus, the opening width of the clamping elements 3*a* and 3*b* is precisely determined, and idle time caused by unused wider openings or paths are avoided.

Figure 4:
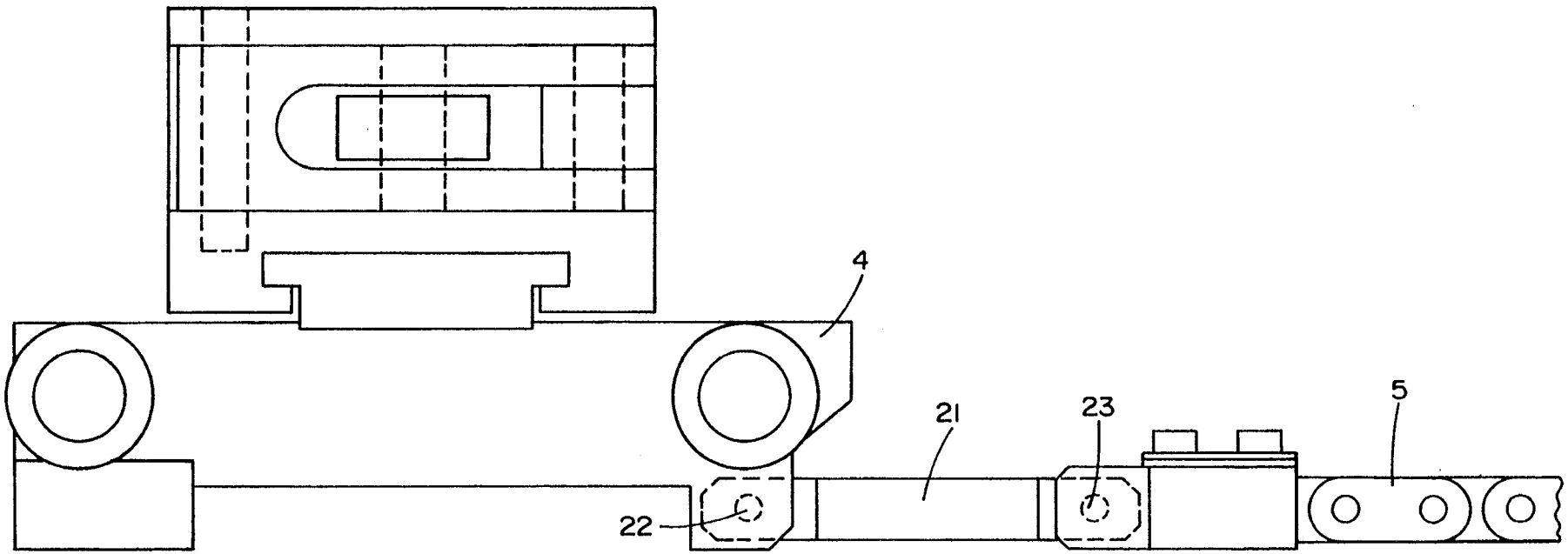
FIG. 4 is a diagrammatic side view of one of the split clamps and support carriages included in the capstan draw apparatus of FIGS. 1 and 2.

Referring to FIG. 4, the endless capstan chains 5 and 5' are employed as pulling elements for each of the support carriages 4 for passage of such carriages along a predetermined path determined by the guide rollers 14 and the lateral guide frames 12 and 12'. To achieve this result, separate pulling rods 21 are provided which are pivotally connected between each support carriage 4 and one of the endless capstan chains 5 or 5', by means of bolt connections 22 and 23. Consequently, even in the curved parts of the endless predetermined paths of the endless lateral guide frames 12 and 12', the support carriages 4 are securely guided and are uniformly moved by the pulling capstan chains 5 and 5', thus permitting efficacious interactions and higher manufacturing speeds.

While the invention has been described in connection with an exemplary embodiment thereof, it will be understood that many modifications will be apparent to those of ordinary skill in the art and that this applications is intended to cover any adaptations or variations thereof. Therefore, it is manifestly intended that the invention be only limited by the claims and equivalents thereof.

What is claimed:

1. A capstan draw apparatus for periodically gripping and drawing an elongated member in a longitudinal path, comprising:

a plurality of split clamps each including a pair of oppositely disposed, clamping elements for transversely closing and engaging and then transversely opening and disengaging the longitudinally drawn, elongated member;

a plurality of support carriages each having one of said split clamps positioned thereon;

an endless capstan chain drive means for longitudinally pulling each of said support carriages in an endless path of rotation, said drive means including first and second endless capstan chains spatially positioned parallel to each other, each of said plurality of support carriages being connected to said pair of capstan chains at different fixed positions along their respective endless lengths;

an elongated frame means positioned along and on opposite sides of a straight path for successively engaging each of said split clamps for successively closing said split clamps about the elongated member for longitudinally drawing same, and then successively opening and disengaging each of said split clamps from the longitudinally drawn, elongated member; and an endless lateral guide frame means including first and second oppositely disposed, parallel endless lateral guide frames that are spatially positioned parallel to said endless capstan chains and extend on opposite sides of said plurality of support carriages for continuously supporting each of said support carriages in a positively guided manner for uniform movement thereof throughout their entire endless paths of rotation.

2. A capstan draw apparatus in accordance with claim 1, wherein said endless lateral guide frame means is the sole support for each of said plurality of support carriages.

3. A capstan draw apparatus in accordance with claim 1, wherein said endless capstan drive means comprises a plurality of pulling rods each pivotly connected between one of said support carriages and one of said endless capstan chains.

4. A capstan draw apparatus in accordance with claim 1, wherein each of said support carriages includes a guide roller that extends therefrom, and each of said lateral guide frames has a U-shaped cross section for receiving and supporting the guide rollers of said support carriages.

* * * * *